US006089823A

United States Patent [19]

Cronin et al.

[11] Patent Number: 6,089,823

[45] Date of Patent: Jul. 18, 2000

[54] MULTI-STAGE VERTICAL TURBINE PUMP WITH COMMINUTION

[75] Inventors: Richard J. Cronin, Westminster, Md.; Paul W. Behnke, Hanover, Pa.

[73] Assignee: Ingersoll-Dresser Pump Company, Liberty Corner, N.J.

[21] Appl. No.: 09/072,073

[22] Filed: May 4, 1998

[51] Int. Cl.[7] ..... B63H 1/14

[52] U.S. Cl. ..... 415/121.1; 415/121.2; 417/424.1; 241/46.06

[58] Field of Search ..... 415/121.1, 121.2, 415/199.1, 199.2, 199.3; 417/365, 423.5, 424.1, 423.12; 241/46.06, 46.02, 46.17

[56] References Cited

U.S. PATENT DOCUMENTS

| | | | |
|---|---|---|---|
| 3,643,877 | 2/1972 | Zimmer | 241/46.02 |
| 4,409,504 | 10/1983 | Wilson et al. | 310/87 |
| 4,801,244 | 1/1989 | Stahl | 416/146 R |
| 5,011,370 | 4/1991 | Sodergard | 415/121.1 |
| 5,016,825 | 5/1991 | Carpenter | 241/46.06 |
| 5,044,566 | 9/1991 | Mitsch | 241/46.04 |
| 5,456,580 | 10/1995 | Dorsch | 416/223 B |

*Primary Examiner*—Edward K. Look
*Assistant Examiner*—Matthew T. Shanley
*Attorney, Agent, or Firm*—Robert F. Palermo

[57] ABSTRACT

An apparatus for reducing between-stage entanglement of fibrous materials around a rotating impeller drive shaft in a multi-stage vertical turbine pump includes a fluted sleeve on the rotating impeller drive shaft and a notched cutter ring fixed to a stationary inner wall of a lower pump stage for engaging with the fluted sleeve to comminute fibrous materials by shearing action between the notches and the flutes. If necessary, a discharge transition piece may be used to adapt the upper end of an upstream pump stage bowl to the lower end of a downstream bowl.

13 Claims, 6 Drawing Sheets

MULTI-STAGE VERTICAL TURBINE PUMP WITH COMMINUTION

BACKGROUND OF THE INVENTION

This invention relates generally to vertical turbine pumps and more particularly to multi-stage non-clog pumps for pumping fluids which may contain fibrous solids.

Vertical turbine pumps are commonly used for pumping sewage and other fluids which contain fibrous solids such as cloth, paper, and/or string. U.S. patent, for a FRONT REMOVABLE BEARING HOUSING FOR A VERTICAL TURBINE PUMP, U.S. Pat. No. 5,993,153, for an OPEN BOWL FOR A VERTICAL TURBINE PUMP describe such pumps and non-clog applications; and they are, in their entireties, incorporated herein by reference.

In some cases, the pressure head attainable with a single stage turbine pump is not sufficient to provide the lift required by the pumping task, and multiple stage pumps must be used as seen in FIG. 1 which illustrates a two-stage pump of the prior art. This may also be accomplished by making a "stack" of single stage pump bowls such as those described in the applications incorporated by reference. However, when such bowls are stacked, the impeller drive shaft is subject to entanglement by rags and other fibrous materials at the points where it passes from the impeller of an upper stage into the stationary pump bowl inner wall of each lower stage. This may result in blockage of flow, jamming the pump impeller, and even breakage of the impeller drive shaft. Clearance of such jamming and repair of such breakage may require complete disassembly of the pump and, thus, in deep pumping applications which require multi-stage pumps, may be very costly.

The foregoing illustrates limitations known to exist in present multiple stage turbine pumps for solids bearing fluids. It would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing an apparatus for reducing between-stage entanglement of fibrous materials around a rotating impeller drive shaft in a multi-stage vertical turbine pump, the apparatus comprising a fluted sleeve on the impeller drive shaft and a notched cutter ring fixed to a stationary inner wall of a lower pump stage for engaging with the fluted sleeve to comminute fibrous materials by shearing action between said notches and said flutes.

The foregoing and other aspects will become apparent from the following detailed description of the invention when considered in conjunction with the accompanying drawings.

DETAILED DESCRIPTION

Figure 1:
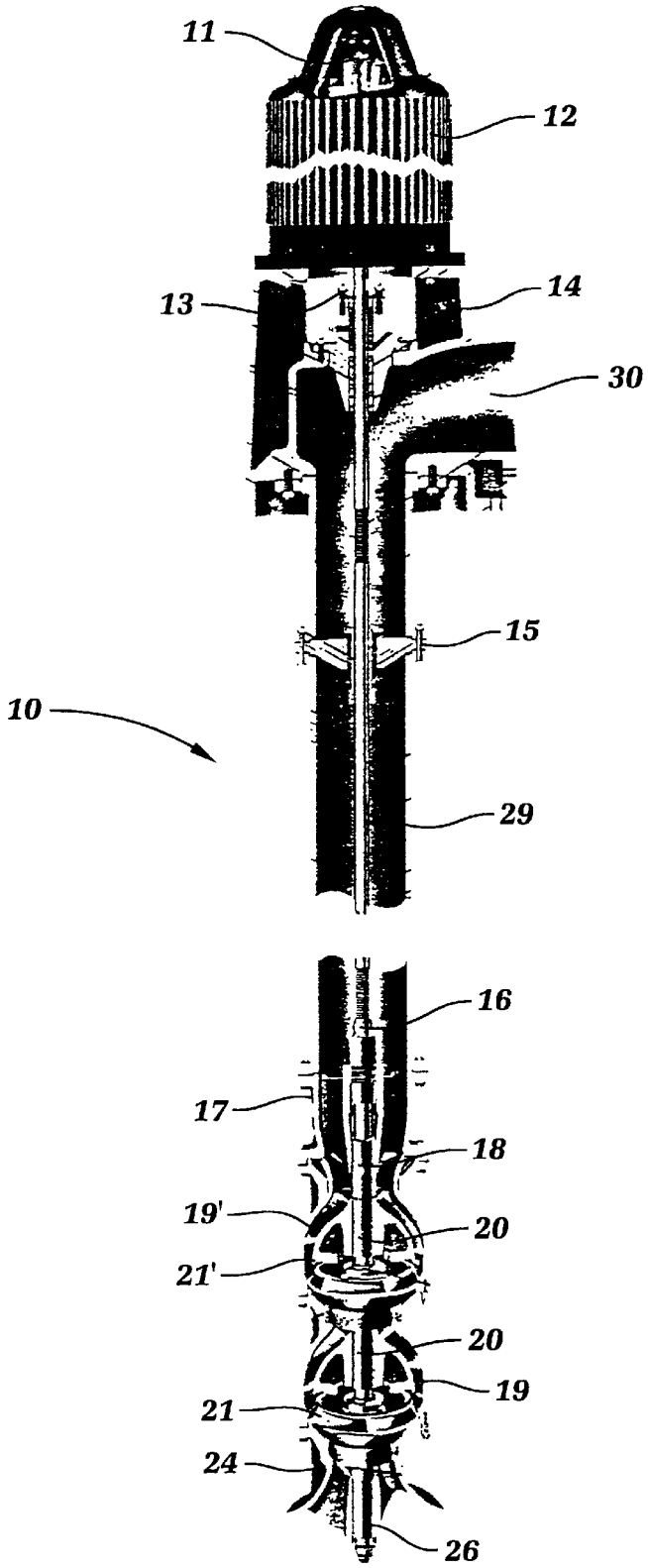
FIG. 1 is a schematic elevation cross-sectional view of a two-stage pump of the prior art.

FIG. 1 is a generalized illustration of a multi-stage pump 10 of the prior art. Note that the impellers 21 are the same in both stages and are, thus, numbered the same. Lower stage pump bowl 19 and upper stage pump bowl 19' are also identical but are differentiated for their differing suction geometries. The pump 10 has a drive motor 12 which may have a hollow shaft drive together with an adjusting nut 11 for vertical adjustment of the lineshaft 16 which drives the impellers 21. The lineshaft 16 passes through a stuffing box 13 or other shaft seal in the discharge head 14 which caps the column pipe 29 and directs flow to the pump discharge 30. The column pipe 29 may be of one or more lengths of piping, as necessary. If more than one section is needed, column connections 15 are provided, preferably as flanges on the mating column sections. In cases of mismatch between the outlet of the upper bowl 19' and the column pipe, an adapter 17 may be needed to connect between them. In the version shown here, the lineshaft 16 is supported by bearings 18, 20, and 26 which are permanently greased and sealed. A suction bell 24 directs fluid into the suction chamber of the lower stage in which the impeller 21 rotates to pump fluid through the pump bowl 19 to the suction chamber of the upper stage. The interface between the bottom of the rotating impeller 21 of the upper stage bowl 19' and the stationary inner wall of the lower stage bowl 19 is the point where entanglement of fibrous materials is most prevalent. This is due to such fibers being picked up by the impeller 21 of the upper bowl 19' and wrapped around the inner wall of the lower bowl 19. There is no such problem at the inlet of the lower bowl; because there is no stationary inner wall below the impeller about which fibers can become wrapped.

Figure 2:
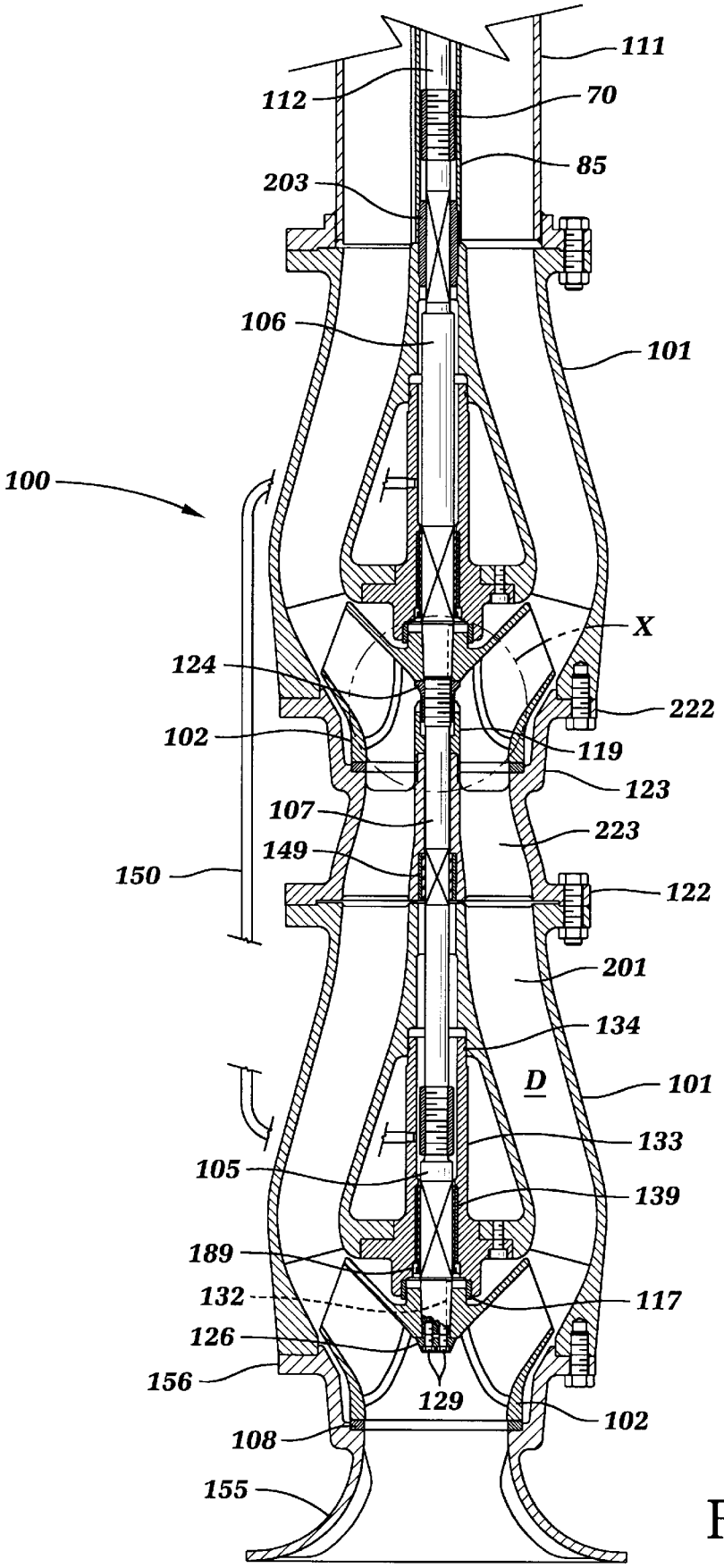
FIG. 2 is a schematic elevation cross-section view of a two-stage pump according to a preferred embodiment of the invention.

FIG. 2 shows a schematic cross-sectional view of a two-stage vertical turbine pump 100 incorporating the invention. The upper and lower bowls 101 are identical as are the impellers 102, which have keys 132 for receiving rotary drive energy from the shaft, and bowl bearing housings 133. The lower bowl impeller 102 is retained on the shaft 106 by a cover plate 126 which is fastened by screws 129. The impellers may also be equipped with wear rings 108 if service conditions so warrant. The bearing housings 133, in a preferred embodiment, are removable from the Pump bowl as a unit which contains the bowl bearing 139, a lip seal 189, and a restriction bushing 117. The bearing housing has a flange for making a sealed connection to the pump bowl inner wall lower end and an o-ring 134 and groove for sealing against the upper end of the wall of the cavity formed by the inner wall about the axis of the bowl.

The upper flange 156 of suction bell 155 is attached to the lower flange of the lower bowl outer wall to direct working fluid into the impeller. The fluid passes through diffuser passages D, between the inner and outer walls of the bowl, and enters the discharge transition 123. The discharge transition has a central wall, which closely conforms to the inner wall of the bowls 101, and a peripheral wall joined by flow splitters 223 which align with diffuser vanes 201 to effectively extend the diffuser passages D through the discharge transition into the intake of the upper bowl. Within the cavity formed by the central wall is a transition bearing 149 for stabilizing the lower end of the transition drive shaft 107 where it connects to the upper end of the lower impeller drive shaft 105. Discharge transition upper flange 222 and lower flange 122 are fastened to the lower flange of the upper bowl and the upper flange of the lower bowl, respectively, to connect the stacked pump stages. If the upper and lower inner walls and outer wall flanges of the pump bowls 101 are suitably designed, the bowls may be connected directly without using a discharge transition 123. Above the upper bowl a column pipe 111 extends upward to a discharge arrangement of a type well known in the art and described above.

Figure 6B:
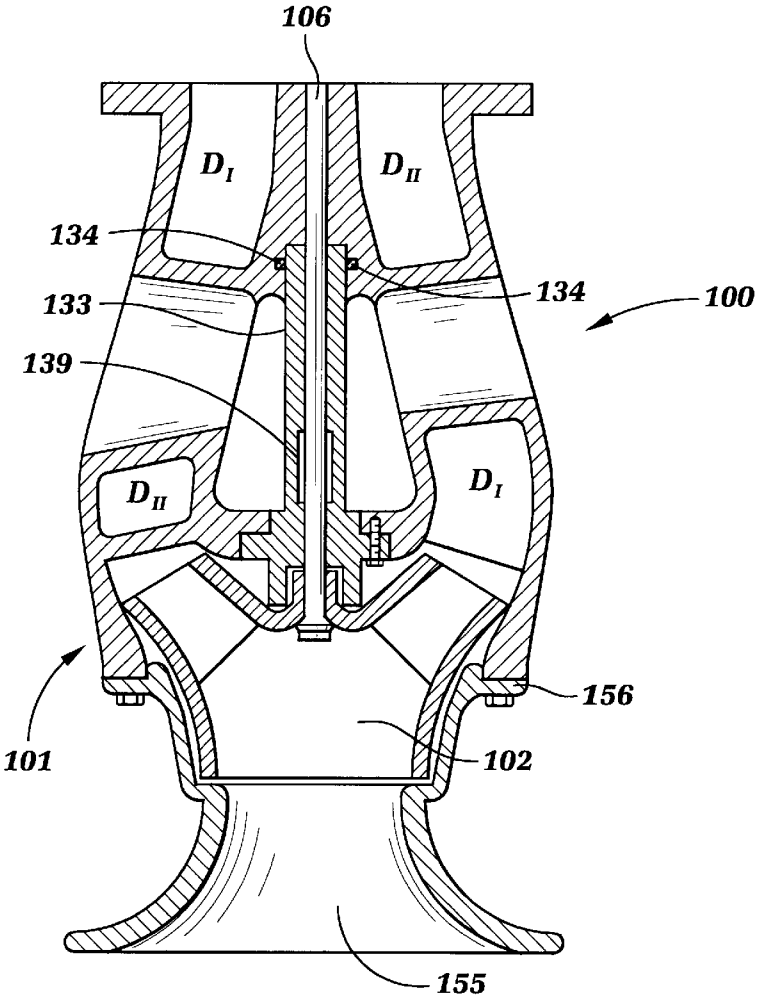
FIGS. 6*a* and 6*b* are schematic pictorial and cross-sectional elevation views, respectively, of a vertical turbine pump with radially hollow diffuser vanes.
Figure 6A:
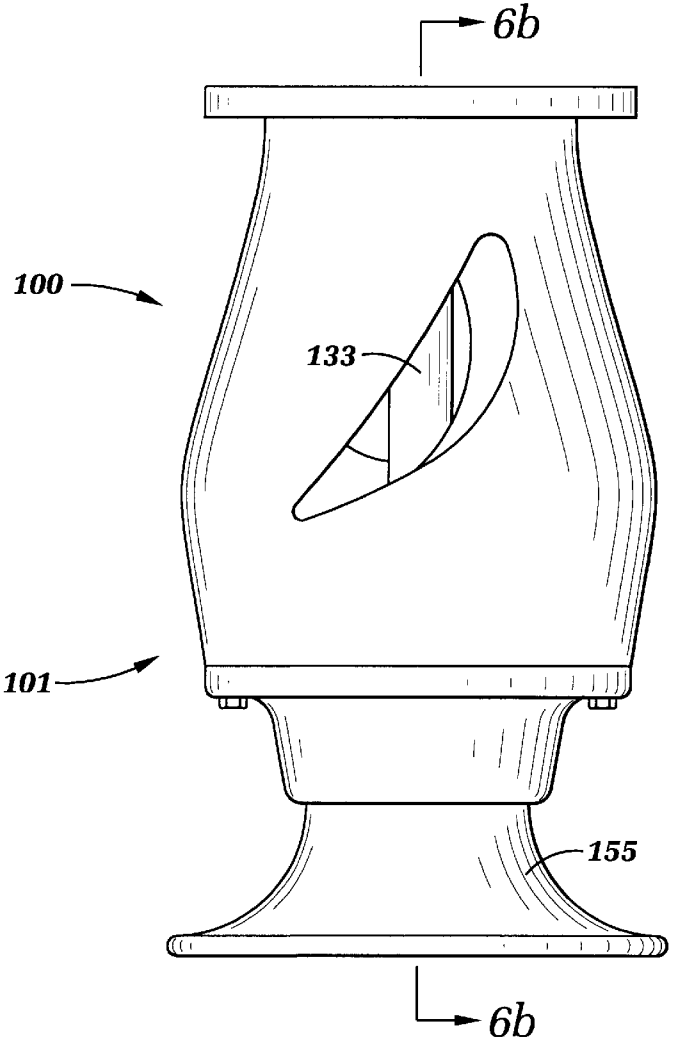

An enclosing tube 85 surrounds the line shaft 112 and provides a clearance through which flushing water is forced downward to flush the line shaft bearings 203 and the bowl bearings 139. Shaft couplings 70 are used to connect between the line shaft 112 and the upper impeller drive shaft 106 which drives the lower impeller drive shaft 105 by means of a non-cylindrical sliding socket coupling. Because of the stacking of stages, a flush water jumper tube 150 is provided to shunt water from the bearing housing 133 of the upper bowl 101 and introduce it into the bearing housing 133 of the lower bowl 101. If the bowl is of the open design, as shown in FIGS. 6*a* and 6*b*, incorporated by reference from U.S. Pat. No. 5,993,153 above, the jumper tube 150 may be passed through one of the radially hollow diffuser vanes and connected to the bearing housing 133. If the bowl is of the standard closed or solid-vane design, then the tube 150 is connected to a radial hole bored through one of the solid vanes into the bearing cavity of the bowl.

Figure 3:
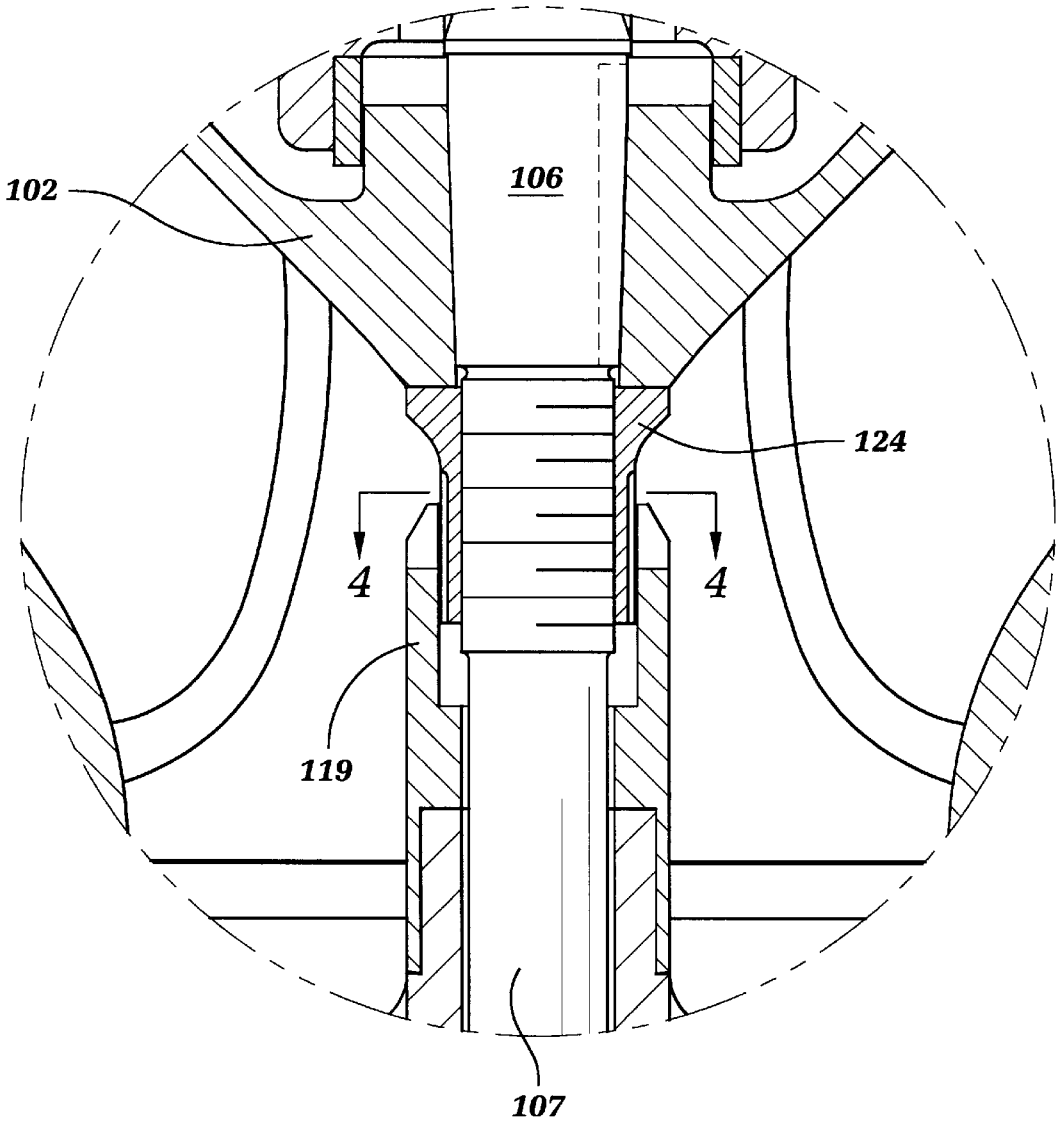
FIG. 3 is an enlarged view of the portion within the circle "X" in the pump illustration of FIG. 2.
Figure 4:
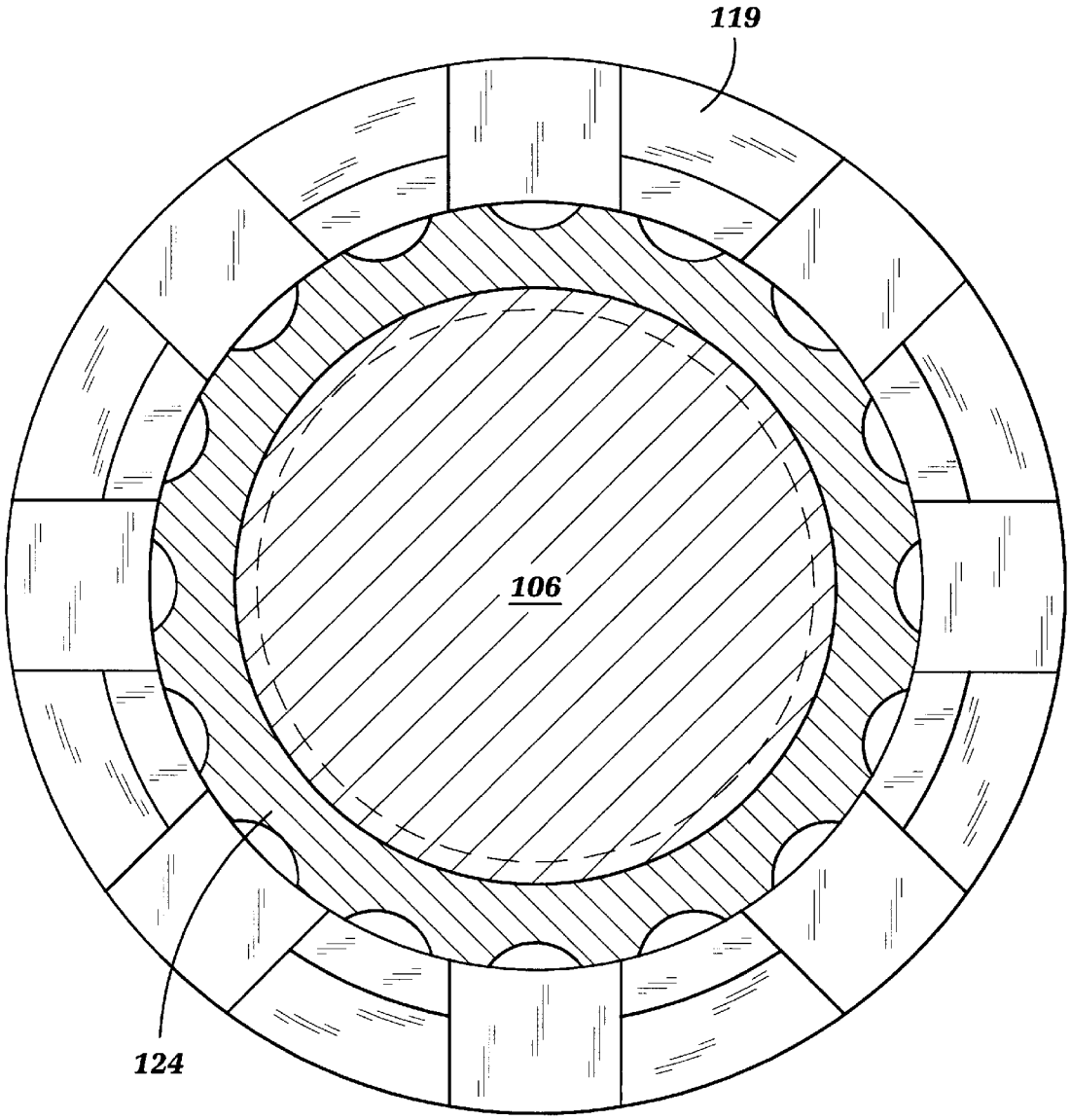
FIG. 4 is a view of a cross-section taken along the line A—A of FIG. 3.
Figure 5:
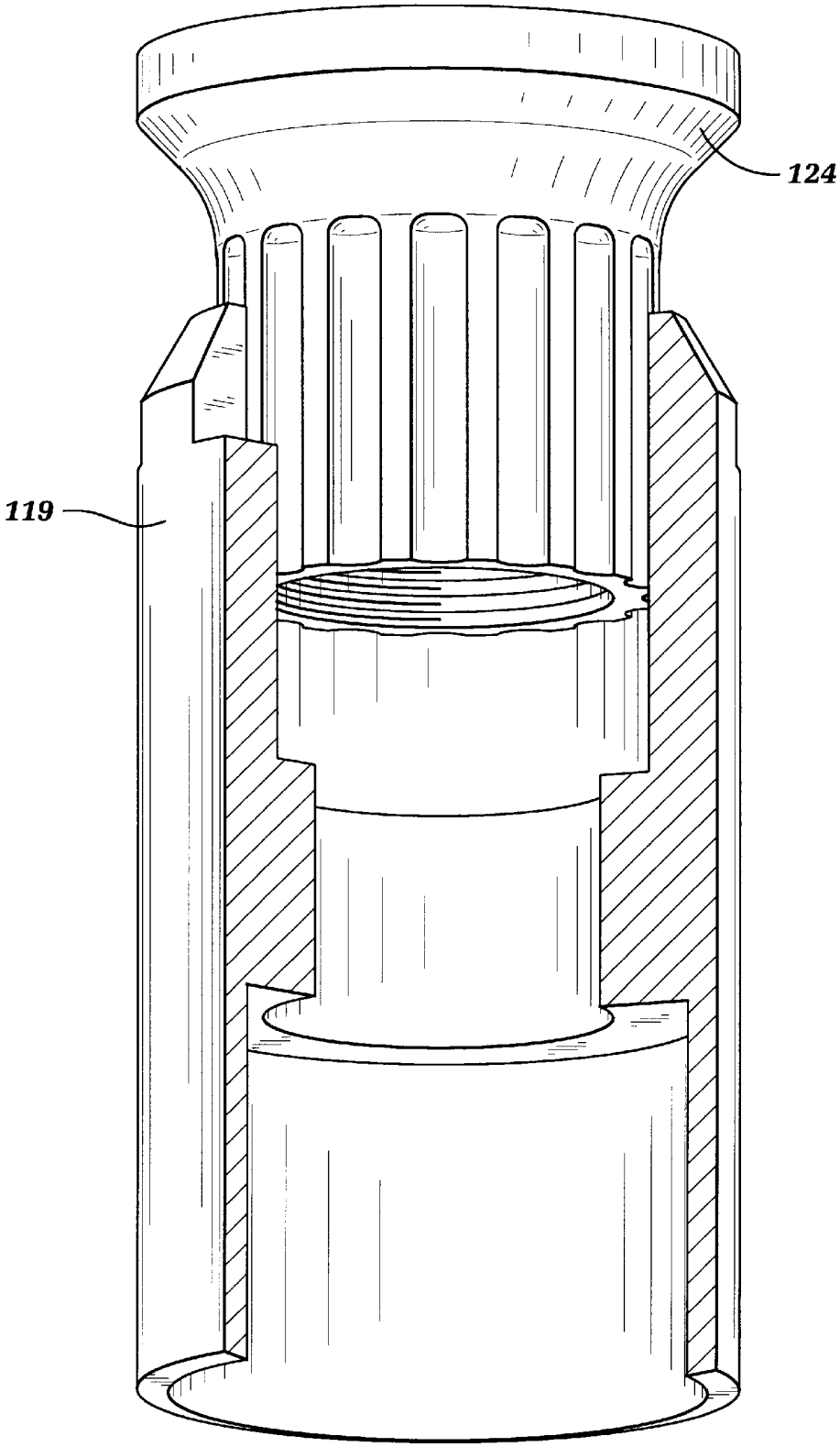
FIG. 5 is a partially cut away view of the notched cutter ring engaged with the fluted sleeve of the impeller shaft.

The comminution device, which reduces between-stage entanglements of fibrous materials, consists of a fluted sleeve 124 drivably engaged by the upper impeller drive shaft 106 and a notched cutter ring 119 fixed to the stationary central wall of discharge transition piece 123. In the case where connections between stages are made without using the discharge transition piece, the cutter ring 119 is fixed to the top of the lower stage bowl inner wall. FIG. 3 shows greater detail of the portion of the pump within the circle "X" of FIG. 2. FIGS. 4 and 5 show greater detail of the comminution device.

Upper impeller drive shaft 106 drives the impeller 102 through a key 132 fitting between the shaft and the impeller. The impeller 102 is axially retained on the shaft by the fluted nut 124 which is threaded onto the shaft 106 and locked in place. To transmit drive beyond the upper impeller 102, the upper shaft has any one of a myriad of well known non-cylindrical sockets (not illustrated) which engages a congruent non-cylindrical projection (not illustrated) on the transition shaft 107 to rotatively drive the transition shaft and, through the transition shaft, the lower impeller drive shaft 105.

The notched cutter ring 119 may be visualized as a crenellated hollow cylinder which surrounds the fluted nut 124 and has a sufficiently close radial fit with the nut that the edges of the flutes and the notches act as shears when the nut turns within the cutter ring. Thus, any fiber which wraps around the fluted nut 124 will be cut between the edges of the flutes and crenellations of the nut 124 and the cutter ring 119. In order to maximize the effectiveness of the comminution device, the flutes are oriented in a slightly helical direction with the handing of the helix determined by the rotation of the pump. This guides any wrapping fibers into the shearing surfaces of the fluted nut 124 and the notched cutter ring 119. The stationary cutter ring 119 is mounted outside the fluted nut 124 in order to minimize the tendency for fibrous materials to wrap around the central wall by having the rotating fluted nut 124 at least partially shielded from the working fluid with its solids contents.

Having described the invention, we claim:

1. An apparatus for reducing between-stage entanglement of fibrous materials around a rotating drive shaft, which drives an impeller in each stage of a multi-stage vertical turbine pump having a first stage and at least a second stage above the first stage, comprising:

a fluted sleeve on said drive shaft below the impeller of each stage above the first stage; and a notched cutter ring fixed to a stationary inner wall surrounding said drive shaft below the impeller of each stage above the first stage for engaging with said fluted sleeve to comminute fibrous materials by shearing action between said notches and said flutes.

2. The apparatus of claim 1, wherein said fluted sleeve comprises a threaded nut which retains the impeller of each stage above the first stage on said drive shaft.

3. In a multi-stage vertical turbine pump having a first stage and at least a second stage above the first stage, of the type in which each pump stage includes a bowl body having outer and inner walls and a vertical axis, one or more diffuser vanes extending between said walls to define diffuser passages extending from a bottom end to a top end, an inlet flange and an outlet flange at the bottom end and the top end, respectively, of said bowl body outer wall, and an axially extending drive shaft drivably engaging an impeller in each pump stage in a suction chamber below said diffuser passages for pumping fluid into and through said diffuser passages, the improvement comprising:

a fluted sleeve on said drive shaft and a notched cutter ring fixed to said inner wall below the impeller of each stage above the first stage for engaging with said fluted sleeve to comminute fibrous materials by shearing action between said notches and said flutes.

4. The improvement of claim 3, wherein the fluted cutter sleeve comprises a threaded nut which retains the impeller of each stage above the first stage on said drive shaft.

5. The improvement of claim 3, further comprising:

a discharge transition piece connecting each pump stage to the pump stage above and having lower and upper flanges for connecting to said lower and upper stage bowls, a central wall surrounding a cavity aligned with those of the inner walls of the upper and lower bowl bodies, and a peripheral wall connected to the central wall by at least one flow splitter which mates to at least one flow splitter of the lower bowl body.

6. The improvement of claim 5, further comprising:

an impeller drive shaft bearing housed within the cavity of the central wall of each said discharge transition piece.

7. A multi-stage vertical turbine pump having a first stage and at least a second stage above said first stage, comprising:

at least first and second stage pump bowls, each pump bowl comprising a bowl body having an inner wall and an outer wall surrounding a vertical axis and connected by diffuser vanes which define diffuser passages extending from a bottom end to a top end through said bowl body, and an axially extending cavity surrounded by said inner wall;

a drive shaft extending axially through said axially extending cavities and having an impeller mounted thereon in each pump bowl;

a suction bell on said first stage pump bowl, said suction bell having a flange for attachment to the bottom end of said outer wall to define a suction chamber in which said impeller is mounted for pumping fluid into and through said diffuser passages;

means for attaching the top end of said first stage pump bowl outer wall to the bottom end of the pump bowl outer wall of the pump stage above, said means comprising a discharge transition piece having lower and upper flanges for connecting to lower and upper stage bowls, a central wall surrounding a cavity aligned with that of the inner wall of the lower bowl body, and a peripheral wall connected to the central wall by one or more flow splitters which mate with flow splitters of the bowl below; and means between each pump stage and the stage next above, for preventing fibrous materials from becoming wrapped around said drive shaft.

8. The multi-stage vertical turbine pump of claim 7, wherein the means between each pump stage and the stage next above, for preventing fibrous materials from becoming wrapped around said drive shaft comprises a fluted sleeve on said drive shaft below the impeller of each stage above the first stage and a notched cutter ring fixed to said inner wall below said fluted sleeve for engaging with said fluted sleeve to comminute fibrous materials by shearing action between said notches and said flutes.

9. The multi-stage vertical turbine pump of claim 8, wherein the fluted sleeve comprises a threaded nut which retains the impeller of the at least second stage on said drive shaft.

10. The multi-stage vertical turbine pump of claim 7, further comprising:

a drive shaft bearing housed within the cavity of the central wall of the discharge transition piece.

11. A multi-stage vertical turbine pump, comprising:

at least two pump bowls axially aligned and joined end-to-end, each pump bowl having a bowl body with inner and outer walls connected by at least one diffuser vane which defines at least one diffuser passage extending from a bottom end to a top end through said bowl body, and an axially extending cavity surrounded by said inner wall;

an impeller drive shaft extending axially through said cavity to drivably engage an impeller in each pump stage;

a suction bell on a first stage pump bowl, said suction bell having a flange for attachment to the bottom end of said outer wall to define a suction chamber from which fluid is pumped into and through said diffuser passages;

a discharge transition piece for connecting between pump stages and having lower and upper flanges for connecting to lower and upper stage bowls, a central wall surrounding a cavity aligned with that of the inner wall of the lower bowl body, a peripheral wall connected to the central wall by at least one flow splitter which mates to at least one flow splitter of the bowl below; and means on said impeller drive shaft and said central wall of said transition piece, between said at least two pump stages, for preventing fibrous materials from becoming wrapped around said impeller drive shaft.

12. The multi-stage vertical turbine pump of claim 11, further comprising:

a separable substantially cylindrical bearing housing, in each pump bowl, extending axially through said cavity and having a circumferential surface for sealing engagement with said inner wall at a top end of said cavity and a flange for sealing attachment to the bottom end of said inner wall, said bearing housing providing support for a lower bowl bearing for said impeller drive shaft extending axially through said cavity.

13. The multi-stage vertical turbine pump of claim 11, wherein the inner walls and outer walls of said bowl bodies are of substantially constant thickness and said diffuser vanes are radially hollow and provide open paths through said inner and outer walls to said axially extending cavities surrounded by said inner walls.

* * * * *

UNITED STATES PATENT AND TRADEMARK OFFICE

CERTIFICATE OF CORRECTION

PATENT NO. : 6,089,823

DATED : July 18, 2000

INVENTOR(S) : Richard J. Cronin, Paul W. Behnke

It is certified that error appears in the above-indentified patent and that said Letters Patent is hereby corrected as shown below:

Column 1, line 11, after "patent " insert --NO. 5,944,482 --.

Column 1, line 13, after "PUMP" insert --and --.

Signed and Sealed this

Third Day of April, 2001

*Attest:*

Nicholas P. Godici

NICHOLAS P. GODICI

*Attesting Officer*

*Acting Director of the United States Patent and Trademark Office*